US009030118B2

(12) United States Patent
Lenk

(10) Patent No.: US 9,030,118 B2
(45) **Date of Patent: *May 12, 2015**

(54) SINGLE INDUCTOR CONTROL OF MULTI-COLOR LED SYSTEMS

(71) Applicant: Switch Bulb Company, Inc., San Jose, CA (US)

(72) Inventor: Ronald J. Lenk, Woodstock, GA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,733

(22) Filed: Oct. 1, 2013

(65) Prior Publication Data

US 2014/0028207 A1 Jan. 30, 2014

Related U.S. Application Data

(63) Continuation of application No. 13/633,054, filed on Oct. 1, 2012, now Pat. No. 8,552,654, which is a continuation of application No. 12/625,486, filed on Nov. 24, 2009, now Pat. No. 8,278,837.

(60) Provisional application No. 61/117,378, filed on Nov. 24, 2008.

(51) Int. Cl.

| | |
|---|---|
| ***H05B 41/16*** | (2006.01) |
| ***H05B 37/02*** | (2006.01) |
| *H05B 33/08* | (2006.01) |

(52) U.S. Cl.

CPC ..... *H05B 37/02* (2013.01); *H05B 33/0809* (2013.01); *H05B 33/0818* (2013.01); *H05B 33/083* (2013.01); *Y10T 29/4913* (2013.01)

(58) Field of Classification Search

USPC ..... 315/247, 224, 225, 185 S, 291, 307–326

See application file for complete search history.

(56) References Cited

U.S. PATENT DOCUMENTS

| | | | |
|---|---|---|---|
| 5,126,634 | A | 6/1992 | Johnson |
| 5,274,611 | A | 12/1993 | Donohoe |
| 5,296,783 | A | 3/1994 | Fischer |
| 5,835,361 | A | 11/1998 | Fitzgerald |
| 6,094,362 | A | 7/2000 | Domingo |
| 6,362,573 | B1 | 3/2002 | Helbing et al. |
| 6,456,015 | B1 | 9/2002 | Lovell et al. |
| 6,717,374 | B2 | 4/2004 | Krummel |
| 7,276,861 | B1 | 10/2007 | Shteynberg et al. |
| 7,358,679 | B2 | 4/2008 | Lys et al. |
| 7,405,715 | B2 | 7/2008 | Guzman et al. |
| 7,431,477 | B2 | 10/2008 | Chou et al. |

(Continued)

OTHER PUBLICATIONS

Non Final Office Action received for U.S. Appl. No. 13/062,207, mailed on Mar. 26, 2013, 10 pages.

(Continued)

*Primary Examiner* — Tuyet Thi Vo

(74) *Attorney, Agent, or Firm* — Morrison & Foerster LLP

(57) ABSTRACT

A circuit for driving multiple light emitting diodes (LEDs) includes at least two sets of LEDs, each set comprised of one or more LEDs in series. The circuit further includes a single inductor connected in series with the two sets of LEDs. At least one set of LEDs is connected to a shunting transistor connected in parallel with the set of LEDs. The duty cycle of the shunting transistor is controlled by a single controller connected to the shunting transistor and the inductor.

16 Claims, 3 Drawing Sheets

(56) References Cited

U.S. PATENT DOCUMENTS

| | | | |
|---|---|---|---|
| 7,675,249 | B2 | 3/2010 | Furukawa et al. |
| 7,863,831 | B2 | 1/2011 | Vos |
| 7,901,107 | B2 | 3/2011 | Van De Ven et al. |
| 7,986,107 | B2 | 7/2011 | Weaver et al. |
| 2001/0038268 | A1 | 11/2001 | Fuchsberger et al. |
| 2006/0175986 | A1 | 8/2006 | Lee et al. |
| 2006/0227840 | A1 | 10/2006 | Spoonhower et al. |
| 2006/0239002 | A1 | 10/2006 | Chou et al. |
| 2006/0244396 | A1 | 11/2006 | Bucur |
| 2007/0040696 | A1 | 2/2007 | Mubaslat et al. |
| 2007/0120507 | A1 | 5/2007 | Uchida et al. |
| 2007/0228999 | A1 | 10/2007 | Kit |
| 2008/0013324 | A1 | 1/2008 | Yu |
| 2008/0024070 | A1 | 1/2008 | Catalano et al. |
| 2008/0130285 | A1 | 6/2008 | Negley et al. |
| 2008/0198615 | A1 | 8/2008 | Klipstein |
| 2008/0211416 | A1 | 9/2008 | Negley et al. |
| 2008/0309255 | A1 | 12/2008 | Myers et al. |
| 2010/0109557 | A1 | 5/2010 | Bouchard |
| 2010/0308739 | A1 | 12/2010 | Shteynberg et al. |
| 2011/0084615 | A1 | 4/2011 | Welten |
| 2011/0163680 | A1 | 7/2011 | Welten |
| 2011/0248644 | A1 | 10/2011 | Welten et al. |

OTHER PUBLICATIONS

Notice of Allowance received for U.S. Appl. No. 13/062,207, mailed on Jul. 23, 2013, 11 pages.
Non Final Office Action received for U.S. Appl. No. 12/625,486, mailed on Nov. 14, 2011, 8 pages.
Non Final Office Action received for U.S. Appl. No. 12/561,514, mailed on Jan. 27, 2012, 6 pages.
International Search Report and Written Opinion received for PCT Patent Application No. PCT/US2009/005628, mailed on Dec. 10, 2009, 8 pages.
International Search Report received for PCT Patent Application No. PCT/US2009/004663, mailed on Sep. 22, 2009, 2 pages.
International Search Report received for PCT Patent Application No. PCT/US2009/004661, mailed on Oct. 2, 2009, 2 pages.
International Search Report received for PCT Patent Application No. PCT/US2009/005021, mailed on Oct. 16, 2009, 2 pages.
International Search Report received for PCT Patent Application No. PCT/US2009/005022, mailed on Nov. 2, 2009, 2 pages.
International Preliminary Report for Patentability received for PCT Patent Application No. PCT/US2009/004661, mailed on Mar. 3, 2011, 6 pages.
International Preliminary Report for Patentability received for PCT Patent Application No. PCT/US2009/004663, mailed on Mar. 3, 2011, 6 pages.
International Preliminary Report on Patentability received for PCT Patent Application No. PCT/US2009/005021, mailed on Mar. 24, 2011, 5 pages.
International Preliminary Report on Patentability received for PCT Patent Application No. PCT/US2009/005022, mailed on Mar. 24, 2011, 6 pages.
International Preliminary Report on Patentability received for PCT Patent Application No. PCT/US2009/005628, mailed on Apr. 28, 2011, 7 pages.
Notice of Allowance received for U.S. Appl. No. 12/625,486, mailed on Jun. 26, 2012, 8 pages.
Notice of Allowance received for U.S. Appl. No. 12/561,514, mailed on May 8, 2012, 7 pages.
Non Final Office Action received for U.S. Appl. No. 13/633,054, mailed on Dec. 12, 2012, 6 pages.
Notice of Allowance received for U.S. Appl. No. 13/633,054, mailed on May 24, 2013, 10 pages.

-- Prior Art --

SINGLE INDUCTOR CONTROL OF MULTI-COLOR LED SYSTEMS

CROSS REFERENCE TO RELATED APPLICATION

This application is a Continuation of U.S. application Ser. No. 13/633,054, filed on Oct. 1, 2012, issued as U.S. Pat. No. 8,552,654 on Oct. 8, 2013, which is a Continuation of U.S. application Ser. No. 12/625,486, filed on Nov. 24, 2009, issued as U.S. Pat. No. 8,278,837 on Oct. 2, 2012, which claims priority to U.S. Provisional Application No. 61/117,378, filed Nov. 24, 2008, which are hereby incorporated by reference in their entireties for all purposes.

BACKGROUND

1. Field

This application relates generally to driving circuits, and more specifically to driving circuits for multi-color light emitting diode (LED) systems.

2. Related Art

Multi-color LED systems are becoming widely used for generating arbitrary light colors in various fields of lighting such as architecture. Multi-color LED systems may be used in the future for generating white light for general service lighting, as the ultimate limits on phosphor conversion for "white" LEDs are reached. The most common systems today employ LEDs in three colors: red, green, and blue (RGB); although other systems using different colors or color spectra and/or different numbers of colors are also in use.

In order to generate arbitrary colors or to generate a particular quality of white light, the light output of LEDs of different colors need to be independently controlled. Specifically, the amount of current supplied to each LED or set of LEDs of a particular color needs to be individually controlled, in order that the resultant color is as desired.

Driving circuits for multi-color LED systems to date have been both complicated and large. In applications in which physical space is at a premium, this can be a serious problem. In particular, LED light bulbs have only a tiny space allotted for the power circuitry, as the circuit must fit within the screw base.

The largest components in current state-of-the-art driving circuits for multi-color LED systems are the inductors. The state-of-the-art driving circuits typically include a switcher operating at a relatively low switching frequency and a relatively large current driving the various LEDs. The low switching frequency necessitates a large inductance value, and hence a large physical size, for the inductor, and similarly the large current requirement also results in the need for a large-sized inductor. While it is possible to reduce the size somewhat by switching at a high frequency, such approach may result in electromagnetic interference (EMI) problems; and in any case, with the current state-of-the-art little can be done along these lines to shrink the size of the inductor due to the current requirements.

Finally, current state-of-the-art driving circuits require one inductor for each LED. Thus, in an RGB system, it is necessary to fit three large inductors within the confines of a bulb. Accordingly, it would be desirable to reduce the size of the inductors in a multi-colored LED drive circuit or system, such that the multi-color LED system can fit within the screw base of a LED light bulb and the volume associated therewith, and such that the multi-color LED system may be used in other space-constrained applications.

SUMMARY

In one exemplary embodiment, a circuit for driving multiple light emitting diodes (LEDs) includes at least two sets of LEDs, each set comprised of one or more LEDs in series. The circuit further includes a single inductor connected in series with the two sets of LEDs. At least one set of LEDs is connected to a shunting transistor connected in parallel with the set of LEDs. The duty cycle of the shunting transistor is controlled by a single controller connected to the shunting transistor and the inductor.

BRIEF DESCRIPTION OF THE FIGURES

The present application can be best understood by reference to the following description taken in conjunction with the accompanying drawing figures, in which like parts may be referred to by like numerals.

DETAILED DESCRIPTION

The following description sets forth numerous specific configurations, parameters, and the like. It should be recognized, however, that such description is not intended as a limitation on the scope of the present invention, but is instead provided as a description of exemplary embodiments.

Figure 1:
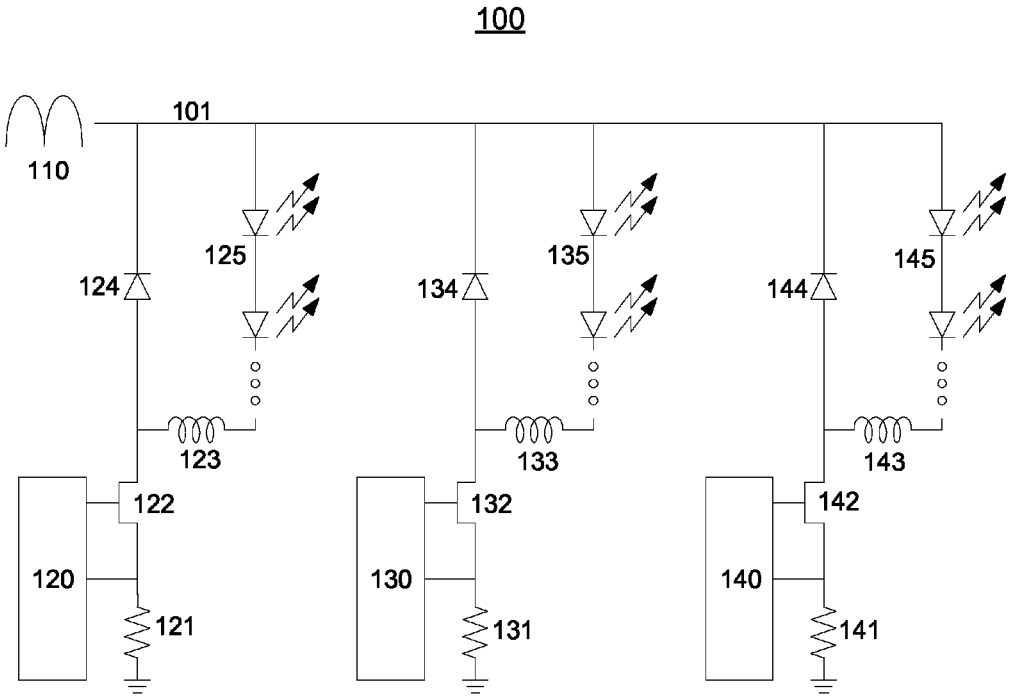
FIG. 1 illustrates a prior art driving circuit for a multi-color LED system.

FIG. 1 is a schematic of a driving circuit 100 driving three sets of LEDs 125, 135, 145, each in different colors, utilizing one converter 120, 130, 140, for each color. In this driving circuit 100, a rectified AC line voltage 110 is applied to a power bus 101. The first set of LEDs 125 is powered from the power bus 101. The first set of LEDs 125 have an approximately constant current fed through them, as they are connected in series with an inductor 123 with a relatively large inductance value. The current through the inductor 123 is maintained by periodic switching of a transistor 122 between an on and off position. When the transistor 122 is on (i.e., in the on position), the current through the inductor 123 flows through the transistor 122 and through the resistor 121 to ground. When the transistor 122 is off (i.e., in the off position), the current through the inductor 123 flows through a diode 124 back to the power bus 101.

Typically, the average current through the inductor 123 is set by the duty cycle of the transistor 122, i.e., the fraction of time that the transistor 122 is on. This in turn is controlled by a controller 120. The controller 120 senses the current through a resistor 121 by measuring the voltage developed across the resistor 121, determines when the current through the inductor 123 is at an appropriate level, and controls the duty cycle of the transistor 122 to achieve this level. In this manner, the average current through the set of LEDs 125 can be set by suitably selecting the value of the resistor 121 in conjunction with the value set by the controller 120.

It should be recognized that the above configuration can be replicated for each set of LEDs, wherein a set of LEDs comprises at least one LED and preferably two or more LEDs in series. For example, in Figure. 1, three such sets of LEDs 125, 135, 145 are shown. Each set of LEDs 125, 135, 145 is in series with an inductor 123, 133, 143, a transistor 122, 132, 142, a sense resistor 121, 131, 141, a controller 120, 130, 140, and a diode 124, 134, 144 respectively. Since each set of LEDs 125, 135, 145 has a sense resistor 121, 131, 141, the current through each set of LEDs 125, 135, 145 can be individually set.

A single controller 120 may be used to control all three sets of LEDs 125, 135, 145. Each of the sets of LEDs 125, 135, 145 is then connected with an inductor 123, 133, 143, a transistor 122, 132, 142, a current sense resistor 121, 131, 141, and a diode 124, 134, 144. It should be recognized that since there are three inductors 123, 133, 143, this configuration would not alleviate the concerns about using multiple inductors in the system.

Figure 2:
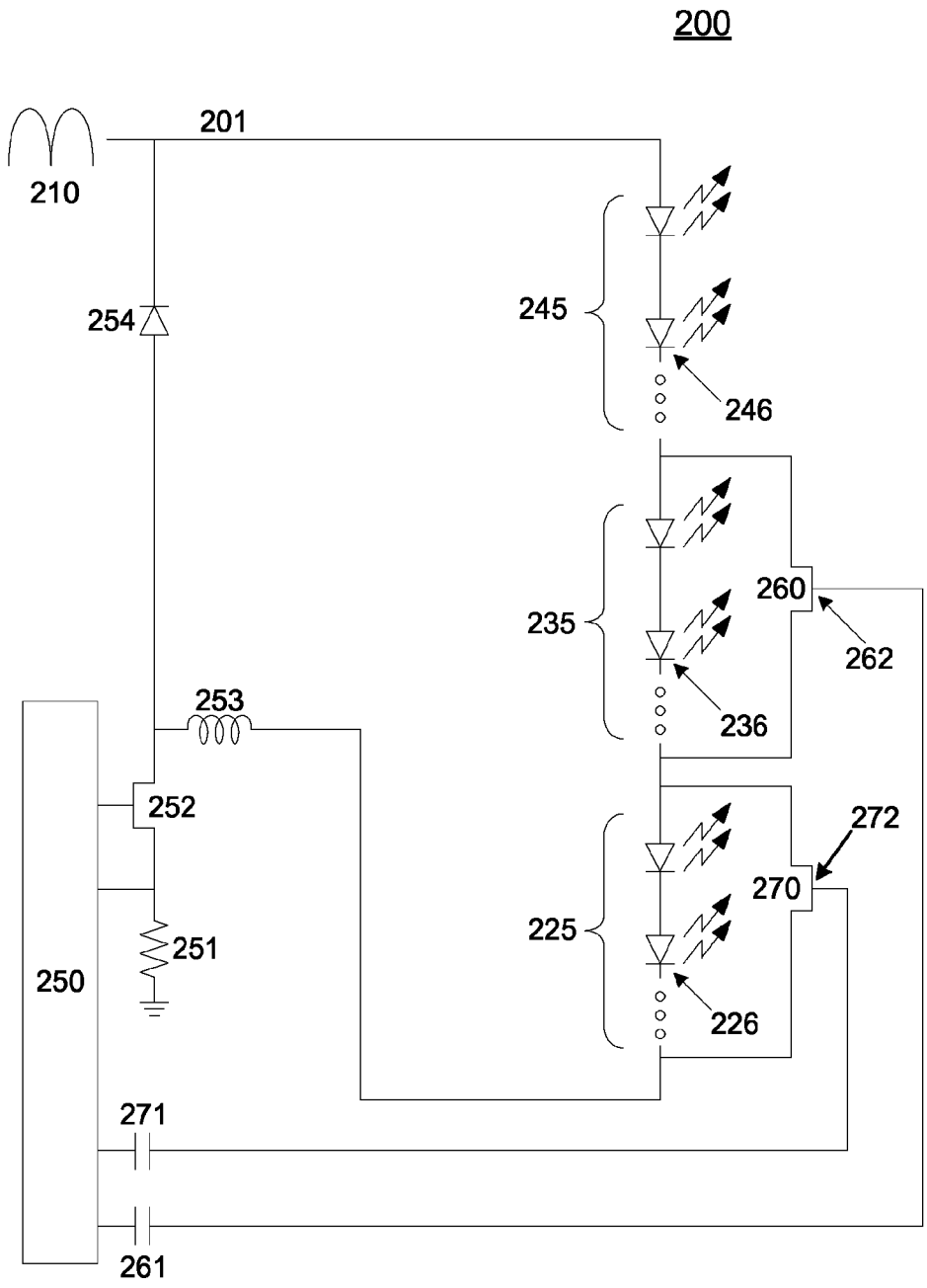
FIG. 2 illustrates an exemplary driving circuit for a multi-color LED system.

FIG. 2 is a schematic of an exemplary driving circuit 200 that utilizes a single inductor 253, a single controller 250, a single diode 254, and a single sense resistor 151 to drive multiple sets of LEDs 225, 235, 245, each set in different colors and each at its own current. In one exemplary embodiment, the controller 250 may be a switching power supply controller. In one exemplary embodiment, each set of LEDs 225, 235, 245 includes at least one LED 226, 236, 246, which may be selected from the following colors or color spectra: red, blue and/or green (i.e., RGB LEDs). In one exemplary embodiment, each set of LEDs 225, 235, 245 includes at least one LED 226, 236, 246, and preferably includes two or more LEDs of the same color or color spectrum in series.

The exemplary driving circuit 200 may include a rectified AC line voltage 210, which is applied to a power bus 201. The third set of LEDs 245 is powered from the power bus 201 and has an approximately constant current fed through it. As shown in FIG. 2, the inductor 253 is connected in series with the sets of LEDs 225, 235, 245. In one exemplary embodiment, the inductor 253 has a relatively large inductance value (e.g., at least 1 millihenry (mH)). The current through the inductor 253 is maintained by periodically switching on and off (i.e., an on position and an off position) the transistor 252. When the transistor 252 is on, the current through the inductor 253 flows through the transistor 252 and through the resistor 251 to ground. When the transistor 252 is off, the current through the inductor 253 flows through the diode 254 and back to the power bus 201. Although one inductor 253 is depicted and described above as being a single inductor, it should be recognized that inductor 253 can comprise two or more inductors in series.

In one exemplary embodiment, the controller 250 determines the current through the un-shunted set of LEDs 245 (i.e., the set of LEDs that is not shunted by any transistor) by measuring the voltage developed across the resistor 251. The controller 250 sets the current through the shunted sets of LEDs 225, 235 (i.e., the first and second sets of LEDs) by controlling the duty cycle of one or more shunting transistors (or bypass transistors) 260, 270. In one exemplary embodiment, the controller 250 can control the duty cycle of the one or more shunting transistors 260, 270 by measuring and compensating for variations of luminosity due to temperature variations of the sets of LEDs 225, 235, 245. In one exemplary embodiment, the controller 250 can control the duty cycle of the one or more shunting transistors 260, 270 by measuring and compensating for variations of luminosity due to aging of the sets of LEDs 225, 235, 245.

For example, in one exemplary embodiment, the average current through the inductor 253 may be set by the duty cycle of the transistor 252, which is in turn controlled by the controller 250. The controller 250 senses the current through the resistor 251 by measuring the voltage developed across the resistor 251, determines when the current through the inductor 253 is at the appropriate level, and controls the duty cycle of the transistor 252 to achieve this level. In this manner, the average current in the third set of LEDs 245 may be set by suitably selecting the value of the resistor 251 in conjunction with the value set by the controller 250.

In one exemplary embodiment, one or more shunting transistors 260, 270 may be connected in parallel with the sets of LEDs 225, 235. As shown in FIG. 2, the current through the two sets of LEDs 225, 235 may be set by controlling the duty cycle of the shunting transistors 260, 270. For example, suppose that the average current through one of the sets of LEDs—for example, the second set of LEDs 235—needs to be 70% of the current through the third set of LEDs 245 and the inductor 253. When the transistor 260 is off, the current from the third set of LEDs 245 flows through the second set of LEDs 235. When the transistor 260 is on, the current from the third set of LEDs 245 is shunted through the transistor 260, and does not flow through the second set of LEDs 235. Thus, the average current through the second set of LEDs 235 may be set to 70% of the current through the third set of LEDs 245 by turning on the transistor 260 30% of the time, and off the remaining 70% of the time. The average current through the first set of LEDs 225 may be set by similar modulation of the duty cycle of transistor 270. It should be recognized that the driving circuit 200 may include greater or fewer than three sets of LEDs without departing from the present invention.

In one exemplary embodiment, the drive to each of the transistors 260, 270 as shown in FIG. 2 is through a capacitor 261, 271. It should be recognized that this type of drive is convenient in that only one component (i.e., capacitor 261 or 271) is needed per shunting transistor 260, 270. On the other hand, such a direct capacitive drive produces both positive and negative voltages on the transistors' gates 262, 272, and consequently the demands on the driver may be increased. In one exemplary embodiment, the controller 250 may control the one or more shunting transistors 260, 270 through a direct drive, such as the direct capacitive drive depicted in FIG. 2. Alternatively, the controller 250 may control the one or more shunt transistors 260, 270 through an indirect drive, such as a transformer.

In FIG. 2, two shunting transistors 260, 270 are shown. Typically, the number of shunting transistors is equal to the number of sets of LEDs minus one. For example, if the number of sets of LEDs is five, an exemplary driving circuit may include four shunting transistors. The shunting transistors shunt all of the sets of LEDs except the set of LEDs with the highest current requirement.

Figure 3:
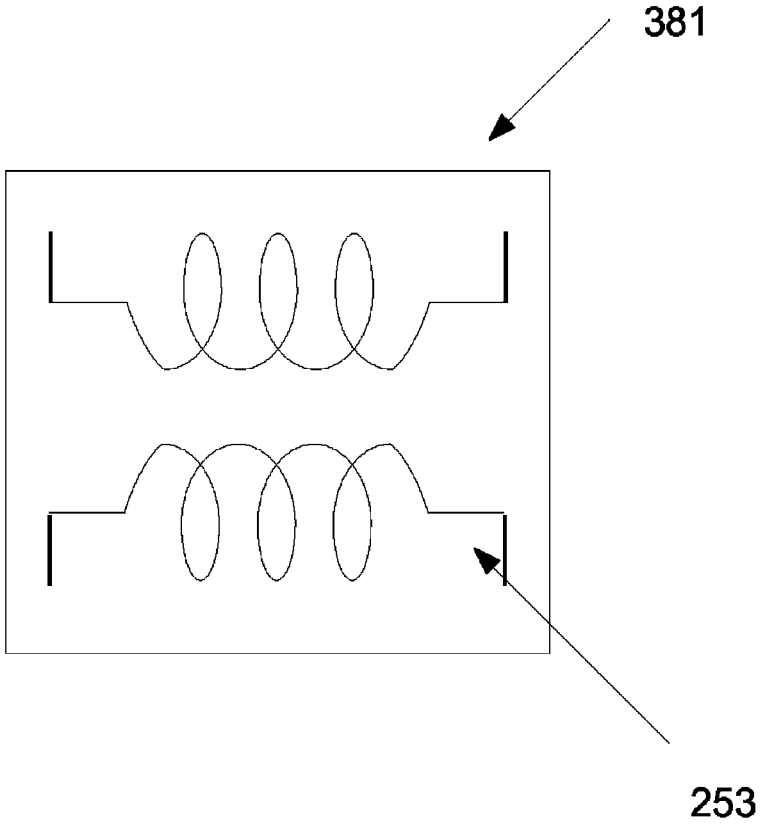
FIG. 3 illustrates a portion of an exemplary driving circuit having an inductor within a transformer.

In one exemplary embodiment, the inductor 253 may be a part of a transformer 381 as shown in FIG. 3. For example, the inductor 253 may be the primary inductance of a flyback transformer. The circuit 200 may include a diode-capacitor arrangement (not shown) or one or more transformers (not shown) to drive the transistor gates 262, 272.

Although only certain exemplary embodiments have been described in detail above, those skilled in the art will readily appreciate that many modifications are possible in the exemplary embodiments without materially departing from the novel teachings and advantages of this invention. For example, aspects of embodiments disclosed above can be combined in other combinations to form additional embodiments. Accordingly, all such modifications are intended to be included within the scope of this invention.

What is claimed is:

1. A circuit for driving multiple sets of light emitting diodes (LEDs), the circuit comprising:

a first set of LEDs comprised of one or more LEDs in series;

a second set of LEDs comprised of one or more LEDs in series, wherein the first set of LEDs is configured to produce different color or color spectrum than the second set of LEDs;

a single inductor connected in series with the first and second sets of LEDs;

a first shunting transistor connected in parallel with the second set of LEDs;

a controller connected to the first shunting transistor, wherein the controller is configured to determine the current through the first set of LEDs, and wherein a first duty cycle of the first shunting transistor is based on the determined current; and wherein the first set of LEDs is not connected in parallel with a shunting transistor.

2. The circuit of claim 1, further comprising:

a resistor connected to the controller, wherein the controller is configured to determine the current through the first set of LEDs by measuring the voltage developed across the resistor.

3. The circuit of claim 1, a controller connected to the first shunting transistor, wherein the controller is configured to control the first duty cycle based on a measurement of a luminosity of the first set of LEDs.

4. The circuit of claim 1, further comprising:

a switching transistor connected to the inductor, wherein the switching transistor is configured to control the current through the inductor.

5. The circuit of claim 1, wherein the one or more LEDs of the first set of LEDs have a higher current requirement than the one or more LEDs of the second set of LEDs.

6. The circuit of claim 1, wherein the inductor is part of a transformer.

7. The circuit of claim 1, further comprising:

a capacitor connected to the first shunting transistor and the controller.

8. The circuit of claim 1, further comprising:

a third set of LEDs comprised of one or more LEDs in series, wherein the third set of LEDs is configured to produce different color or color spectrum than the first and second sets of LEDs, wherein the third set of LEDs is connected in series to the single inductor; and a second shunting transistor connected in parallel with the third set of LEDs.

9. The circuit of claim 8, wherein the one or more LEDs of the first set of LEDs are configured to produce red color, wherein the one or more LEDs of the second set of LEDs are configured to produce blue color, and wherein the one or more LEDs of the third set of LEDs are configured to produce green color.

10. A circuit for driving multiple sets of light emitting diodes (LEDs), the circuit comprising:

a first set of LEDs comprised of one or more LEDs in series;

a second set of LEDs comprised of one or more LEDs in series;

a third set of LEDs comprised of one or more LEDs in series, wherein the first set of LEDs is configured to produce different color or color spectrum than the second and third sets of LEDs;

a single inductor connected in series with the first, second, and third sets of LEDs;

a first shunting transistor connected in parallel with the second set of LEDs;

a second shunting transistor connected in parallel with the third set of LEDs;

a controller connected to the first shunting transistor and the second shunting transistor, wherein the controller is configured to determine the current through the first set of LEDs, and wherein a first duty cycle of the first shunting transistor and a second duty cycle of the second shunting transistor is based on the determined current, and wherein the first duty cycle and the second duty cycle are different; and wherein the first set of LEDs is not connected in parallel with a shunting transistor.

11. The circuit of claim 10, further comprising:

a resistor connected to the inductor and the controller, wherein the controller is configured to determine the current through the first set of LEDs by measuring the voltage developed across the resistor.

12. The circuit of claim 10, further comprising:

a switching transistor connected to the inductor, wherein the switching transistor is configured to control the current through the inductor.

13. The circuit of claim 10, further comprising:

a first capacitor connected to the first shunting transistor; and a second capacitor connected to the second shunting transistor.

14. A method of building a circuit for driving multiple sets of LEDs, the method comprising:

connecting a single inductor in series to a first set of LEDs comprised of one or more LEDs in series;

connecting the first set of LEDs in series to a second set of LEDs comprised of one or more LEDs in series, wherein the first set of LEDs is configured to produce different color or color spectrum than the second set of LEDs;

connecting a first shunting transistor in parallel with the second set of LEDs, wherein the first set of LEDs is not connected in parallel with a shunting transistor; and connecting a controller to the first shunting transistor, wherein the controller is configured to determine the current through the first set of LEDs, and wherein the controller is configured to set a first duty cycle of the first shunting transistor based on the determined current.

15. The method of claim 14, further comprising:

connecting a resistor to the inductor and the controller, wherein the controller is configured to determine the current through the first set of LEDs by measuring the voltage developed across the resistor.

16. The method of claim 14, further comprising:

connecting the second set of LEDs in series to a third set of LEDs comprised of one or more LEDs in series, wherein the third set of LEDs is configured to produce different color or color spectrum than the first and second sets of LEDs;

connecting a second shunting transistor in parallel with the third set of LEDs; and connecting a controller to the first shunting transistor and the second shunting transistor, wherein the controller is configured to control first duty cycle of the first shunting transistor and a second duty cycle of the second shunting transistor.

* * * * *